US007470036B2

(12) United States Patent
Deighton et al.

(10) Patent No.: US 7,470,036 B2
(45) Date of Patent: Dec. 30, 2008

(54) LIGHTING SYSTEM

(75) Inventors: Kevin Deighton, Long Beach, CA (US); Greg Rhoads, Irvine, CA (US)

(73) Assignee: Pelican Products, Inc., Torrance, CA (US)

( * ) Notice: Subject to any disclaimer, the term of this patent is extended or adjusted under 35 U.S.C. 154(b) by 27 days.

(21) Appl. No.: 11/692,901

(22) Filed: Mar. 28, 2007

(65) Prior Publication Data

US 2008/0239712 A1 Oct. 2, 2008

(51) Int. Cl.
*F21V 33/00* (2006.01)

(52) U.S. Cl. ..... 362/109; 362/382; 362/384; 362/385; 362/386; 362/403; 362/410; 362/411; 362/414; 362/431; 362/154; 362/183; 362/190; 362/191; 362/198; 362/294

(58) Field of Classification Search ..... 362/109, 362/382, 384, 385, 386, 388, 391, 403, 410, 362/411, 414, 431, 154, 183, 190, 191, 198, 362/294, 286, 399
See application file for complete search history.

(56) References Cited

U.S. PATENT DOCUMENTS

| | | | |
|---|---|---|---|
| 3,223,826 | A | 12/1965 | Macaluso, Jr. |
| 3,463,916 | A | 8/1969 | De Bella |
| 3,495,364 | A | 2/1970 | De Bella |
| 4,143,413 | A | 3/1979 | Kelly |
| 4,220,981 | A | 9/1980 | Koether |
| 4,600,980 | A | 7/1986 | Dahlgren |
| 4,935,854 | A | 6/1990 | Kernodle |
| 5,012,394 | A | 4/1991 | Woodward |

(Continued)

FOREIGN PATENT DOCUMENTS

| | | |
|---|---|---|
| DE | 202 00 634 U1 | 5/2002 |

(Continued)

OTHER PUBLICATIONS

"Increased power & innovative designs charge up new battery products", source(s): Gale Group PROMT®.

(Continued)

*Primary Examiner*—Stephen F Husar
*Assistant Examiner*—Jessica L McMillan
(74) *Attorney, Agent, or Firm*—Greenberg Traurig, LLP

(57) ABSTRACT

A light head is mounted on a common base, and includes a light source in a mounting base. The base is mounted on a collapsible elongated pole, and the pole is for mounting on an outside wall of a carrying case. There is a carrying handle for the case, an electrical power outlet mounted on a wall, base or lid of the case and for plugging in an electrical wire to power the light head. The interior of the case is for locating a rechargeable battery, and the battery when charged, supplies power to the power outlet such that the light head can be powered. Recharging can be via either a 12V DC automobile or a 110 AC power supply. The carrying handle is extendible; and retractable, and in the retraction mode is essentially within the general perimeter space of the case. The case includes a pair of pulley wheels, the wheels being for facilitating the moving of the case.

18 Claims, 4 Drawing Sheets

U.S. PATENT DOCUMENTS

| | | | | |
|---|---|---|---|---|
| 5,219,446 | A * | 6/1993 | Klepac | 362/154 |
| 5,272,609 | A | 12/1993 | Nelson | |
| 5,418,701 | A | 5/1995 | Hart | |
| 5,459,648 | A * | 10/1995 | Courtney | 362/154 |
| 5,806,963 | A | 9/1998 | Miller et al. | |
| 5,890,793 | A | 4/1999 | Stephens | |
| 6,019,484 | A | 2/2000 | Seyler | |
| 6,164,801 | A | 12/2000 | Alexander-Katz | |
| 6,517,225 | B1 | 2/2003 | Allen et al. | |
| 6,659,620 | B2 | 12/2003 | Goto | |
| 6,682,209 | B2 * | 1/2004 | Drake et al. | 362/403 |
| 6,926,428 | B1 * | 8/2005 | Lee | 362/431 |
| 7,192,154 | B2 | 3/2007 | Becker | |
| 7,309,137 | B2 | 12/2007 | Chan | |
| 2003/0137847 | A1 | 7/2003 | Cooper | |
| 2005/0018435 | A1 | 1/2005 | Selkee et al. | |
| 2005/0254237 | A1 * | 11/2005 | Nath et al. | 362/190 |
| 2006/0209547 | A1 | 9/2006 | Biondo et al. | |
| 2006/0256568 | A1 | 11/2006 | Ellis | |

FOREIGN PATENT DOCUMENTS

| | | |
|---|---|---|
| GB | 2414069 | 11/2005 |
| IT | 1248316 | 1/1995 |
| WO | WO 02/44503 A | 6/2002 |

OTHER PUBLICATIONS

"Gator Rolling Light and Stand Case", source(s): http://www.bananas.com/productdetail.asp/pid_3916/productname_ Gator-Rolling-Light-and-Stand-Case.

"R.C. Flagman is the world leader in traffic control devices", source(s): http://www.rcflagman.com/.

European Search Report, dated Apr. 3, 2008, from EP 07 11 9450.

* cited by examiner

LIGHTING SYSTEM

BACKGROUND

1. Field

The present disclosure relates to a portable light and cases for storing and carrying the light when not in use.

2. General Background

Portable lights are useful in emergency situations, and a variety of settings such as construction sites, industrial plants, automotive and auto body repair shops, artist and photographic studios, and around the home for do-it-yourself projects. These lights provide a high level of illumination over an extended area. The lights are either set on a low, typically built-in supporting stand that can be placed in a stable position on the ground or other work surface or they are secured to an upright stand such as a pole or extendible pole for greater height off the work surface.

There is a need for emergency lights which can be moved to emergency sites easily. Also on specific projects, for instance, construction projects, lights are used so commonly that they are considered by many to be indispensable accessories.

The storage and transportation of the light, for example in the back of a pickup truck, and storing the light, needs to be of a nature avoiding unwanted wear and tear and possible damage. Some known lights come in a case that requires the light to be disassembled to be packed in the case. However, this is not efficiently and effectively done.

There is a need for a portable lighting system in a compact case, and a system which is convenient to assemble and to permit safe storage and then to permit easy reassembling, and also to permit easy portability to remote or different sites for use.

SUMMARY

A light and a case for carrying and storing a light is provided. The case body provides the mounting base for an extendible pole which mounts the light. A rechargeable power source is provided in the case, and a removable electrical cord can connect with the case and the light source to thereby power the light source.

The case and light do not require complex disassembly and assembly of components before the light that is stored in the case is usable. The light may be configured so as to require little or no disassembly of the light before being packed into the case. For lights that are used with an extendible telescopic pole, the pole may also be conveniently located in the case generally detached from the light. This provides a great convenience to the user in that the light may be removed from the case ready for use with little or no assembly required and can be packed into the case just as quickly and conveniently. Moreover, the unit is stored in the case in a manner protecting against damage to the light head during transport.

The case has a portion including one or more locations, bays formed for receiving an individual light head. The locations or bays are disposed in the bottom or top portion of the case so that the light head rests securely in position. There can be one or ore securing anchors in the case. The various surfaces of the top or bottom portion are formed to allow space for the light base so that the light head need not be disassembled from the base. Adequate space is left over for storing the extendible pole and cord as well. This arrangement is particularly desirable with LED light panels and also high-voltage halogen lights, which generate much heat.

Other aspects, advantages, and novel features of the disclosure are described below or will be readily apparent to those skilled in the art from the following specifications and drawings of illustrative embodiments.

DETAILED DESCRIPTION

Figure 1:
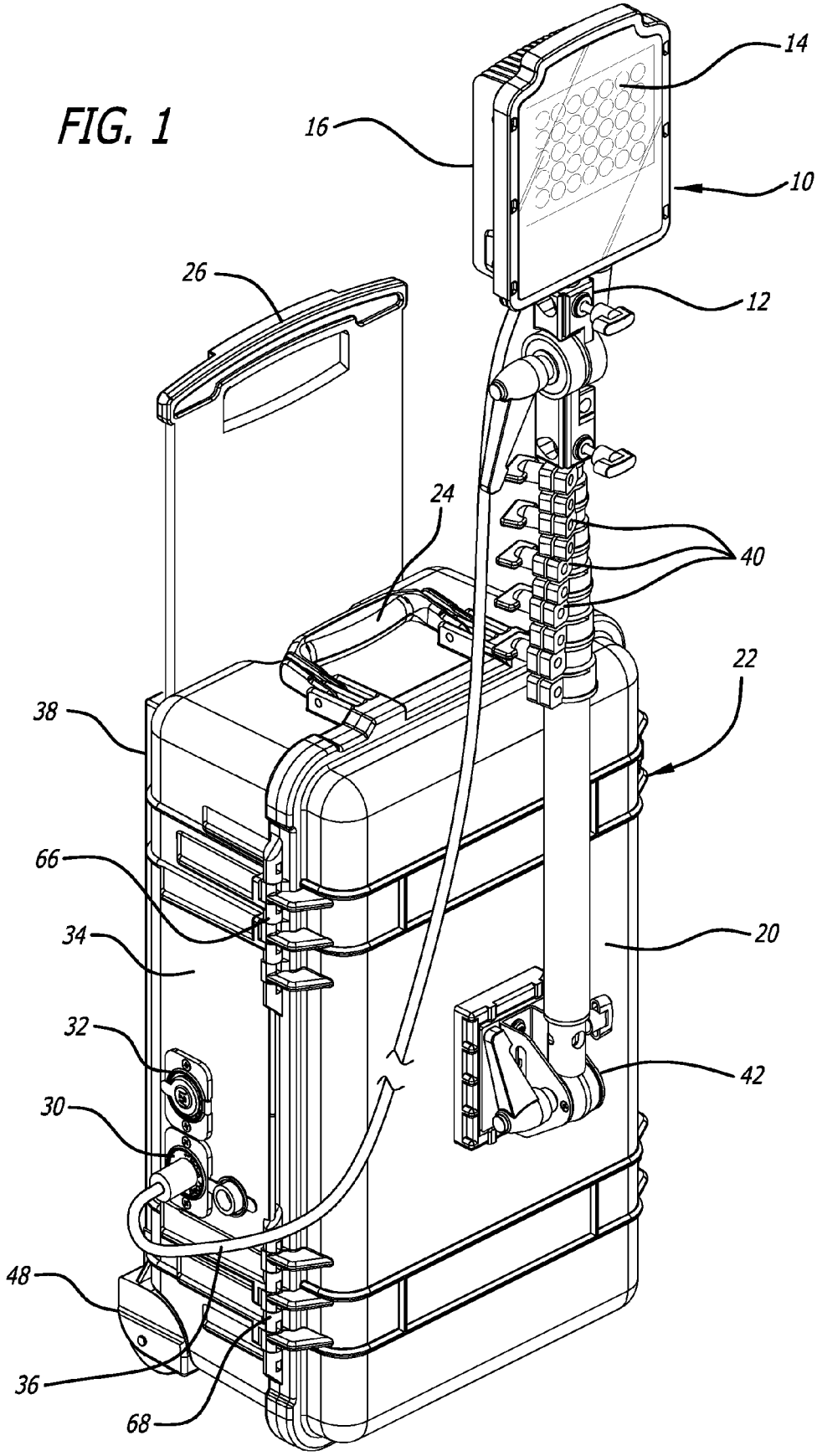
FIG. 1 is an overall view of a case with a light mounted on a lid for the case. The case is vertically disposed, and shows the extended handle and the pulley wheels. The electrical cable is also shown connected to an outlet in a side wall of the case.
Figure 2:
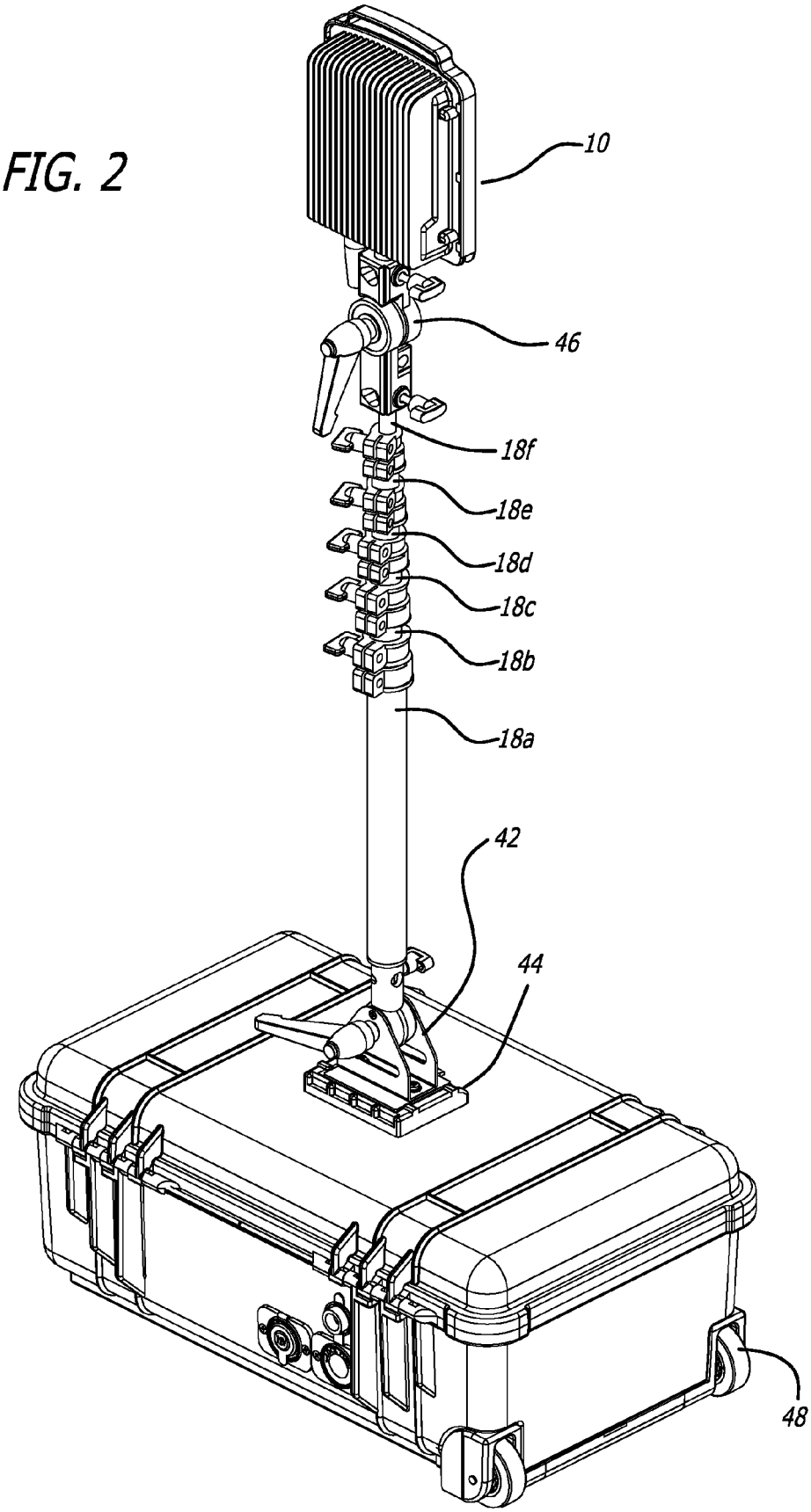
FIG. 2 is an overall view of a case with a light mounted on a lid for the case, and extended differently, and with the case extending horizontally on its base. The case shows the pulley wheels, and the electrical cable is also shown connected to the lamp.
Figure 3:
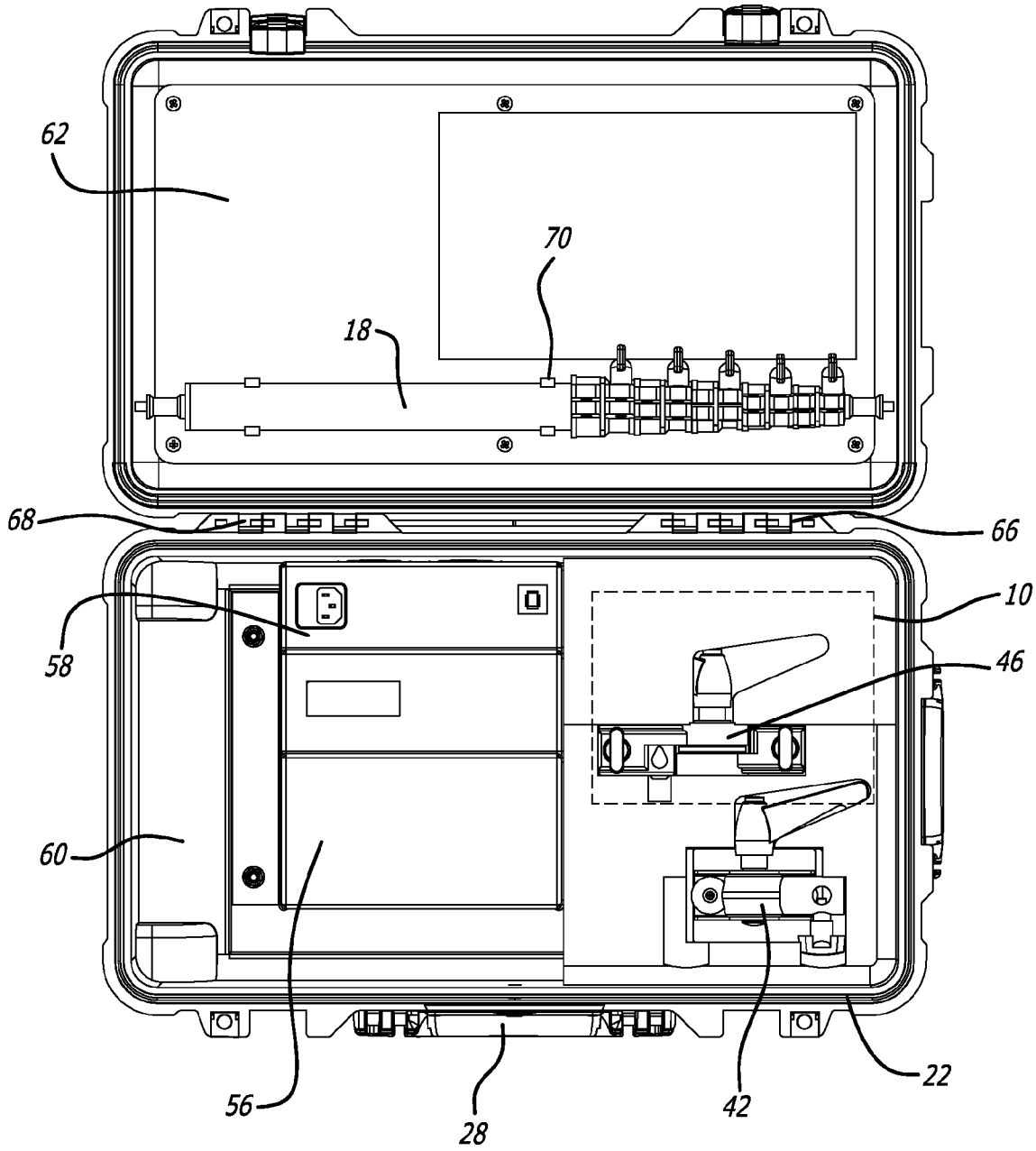
FIG. 3 is a view of an embodiment of a case in open configuration according to the disclosure, and showing the rechargeable battery, housing for the pole and the connectors for different components of the pole and the case.
Figure 4:
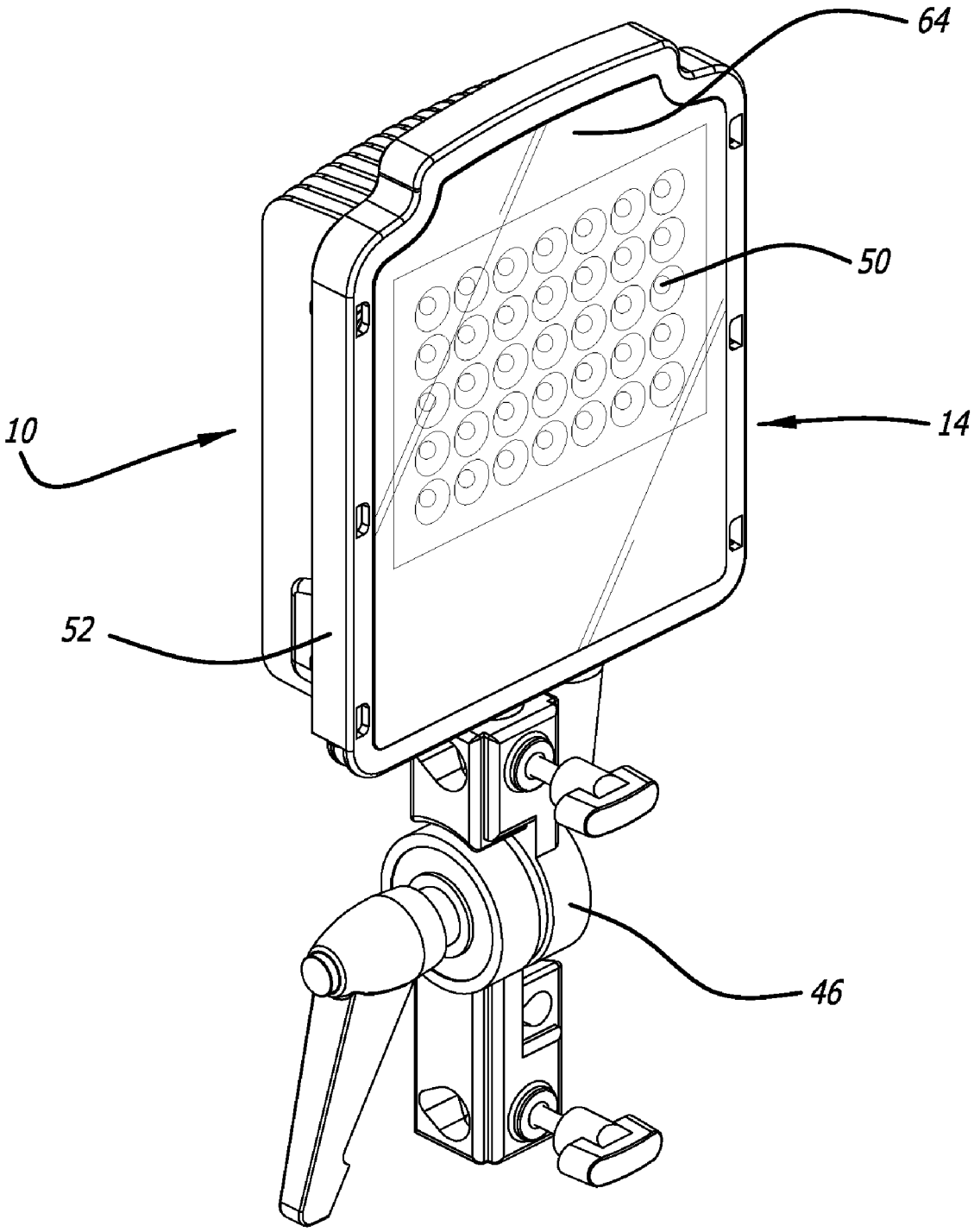
FIG. 4 is an overall view of a light source and its mounting base.

A system for providing lighting comprising a light head 10 mounted on a base 12. The light head 10 includes a light source 14 in a mounting housing 16. The base 12 is mounted on a collapsible elongated pole 18, and the pole 18 is for mounting on the outside of a lid 20 of a carrying case 22.

The carrying case 22 is for locating the light head 10 and the collapsible pole 18 and other peripheral components when the light is not in use. There are several carrying handles 24, 26 and 28 for the case 22. There is also a double electrical power outlet 30 and 32 mounted on a wall 34 of the case 22 for plugging in an electrical wire 36 to power the light head 10. The length of the electrical wire or cord 36 may typically range from 8 to 12 feet.

The case 22 includes a base 38 and the lid 20. The interior of the case 22 is for locating a rechargeable battery 40, and the battery, when charged, supplies power to the power outlets 30 and 32 such that the light head 10 can be powered.

The pole 18 has components 18*a*, 18*b*, 18*c*, 18*d*, 18*e* and 18*f* which are telescopic relative to each other such that the pole 18 can be extended or collapsed. These pole sections can be selectively locked through releasable locks 40 at different degrees of extension. In the collapsed state the pole sections are for location in an interior portion of the case 22.

There is at least one connector element 42 being for securing the pole 18 to outside of the lid 20 of the case 22. There is a connecting member 44 mounted on the outside of the lid 20. The connector elements 42 and 44 are such that the angular relationship of the components 42 and 44 can be varied. As such as shown in one form the light can extend vertically when the case is lying down with the base on the ground. In another form such as shown, the light can extend vertically when the case is lying with an end on the ground. There is also a connector element 46 for securing the light head 10 to the top of the pole 18.

One of the carrying handles, namely handle 26 is extendible; and retractable relative to the body of the case 22. In the retraction mode it is essentially within the general perimeter space of the case 22. The case 22 includes a pair of pulley wheels 48, the wheels 48 being for facilitating the moving of the case 22.

The light source 10 in the mounting housing 16 includes the light head 10 with a panel of multiple LEDs 50 mounted into a cast aluminum heat sink 52. The panel of LEDs 50 is an articulating light panel. The light source 10 is mounted on the extension telescopic pole 18 through anchorage 46.

In different forms, the opposite end of the pole 18 can mount on to the wall, lid or top of the case 22.

Inside the case 22 there is a battery 56 and charger 58 which is chargeable via either a 12V DC automobile battery or supply source or a 110 AC power supply.

The case 22 is formed of a relatively water and dust resistant plastic, and a seal is provided between movable components of the case 22 to facilitate this resistance.

The case 22 includes defined housings, locations or bays 60 ad n62 in the bottom portion and top portion of the case 22 respectively. Each defined location, housing or bay 60 and 62 is formed to receive respectively the light 10 or other connector components of the light or pole 18.

The mountings 42 and 44 are secured for facilitating the mounting of the support pole 17, and for permitting adjustment of the light and turning of the light to face different directions and for aiming the head.

The support is a typical retractable, telescoping-style pole that may be detached from the light. The light is removably secured to the pole at bracket where it is held by an anchorage that can be tightened and loosened by knob. Many other forms of structure and anchorage are possible.

The light head which includes the panel of LEDs 50 mounted in a base can have in t e front a protective glass shield 64 covering the chamber holding the light LEDs 50.

A carrying case for the light accommodates the light head 10 while secured to the base member support 11. An electrical outlet box 23 is mounted on a side wall of the case. There are two separate outlets can be used, one by the light and the other for some other needed purpose requiring power.

The components of the light can be accommodated in the case 22, with no or little disassembly. The pole 17 is in its retracted, detached configuration and a functional length of electrical cord 36 is locatable in a housing or with an anchorage in the case.

The case includes a bottom portion 31 and a top portion 32. The top portion is secured to the bottom portion typically by hinging in the manner of a conventional case. Although this is typically achieved with two or more hinge attachments, such as hinges 66 and 68, or one extended hinge attachment, the top and bottom may be secured to one another by any convenient means. For example, instead of the conventional hinge arrangement, in some embodiments it may be desirable to clamp them together around their periphery so that the top may be completely separated when removed.

The particular manner in which the top and bottom are joined and the manner of securing is referred to generally as "hinged".

The bottom portion of the case 22 includes one or more housings, bays or compartments 62 and 64 which are formed to receive the light 10 and other support components.

In general in accord with the disclosure the bottom portion will include one or more bays for the light head and the bays are disposed in the bottom portion so that the head rests in its bay when the light is in its storage position in the bottom portion.

The pole 18 is positioned in its retracted configuration so that brackets 70 in the wall of the top housing 62 can permit securing of the pole 18 in the case 22. Sufficient space is allowed for the pole 18 to fit and be clamped in place in the case 22. Adequate space exists in the case 22 for the light head 10, the bracket 46, other brackets and couplings, the internal portion of the electrical outlet boxes 30 and 32 and the cord 36.

The tubular members 18*a* through 18*f* extend approximately vertically, and the light base member and mounting brackets 60 for the light head fits on the extendible pole 18 through the bracket to hold it in position.

The top portion of the case 22 is formed with a slightly raised portions which serves to provide structural integrity to the case. Similarly, side members serve to provide structural integrity. The edges of the top and bottom portions of the case 22 are formed in known fashion with an interference fit of mating edges for snugly closing the case.

Although, the light shown is of the type commonly referred to as a LED light, other lights can be used. In other cases there could be quartz halogen lights. The light source should provide longer life, greater luminous efficacy, higher color temperature, and little or no light depreciation with age.

For economical manufacture the case portions may generally be blow-molded in a one-piece construction. Nevertheless, in some embodiments it may be desirable to form the housings, bays as an insert to be secured in a separately molded bottom or top portion shell of the case 22.

The above descriptions and drawings are given to illustrate and provide examples of various aspects of the disclosure in various embodiments. It is not intended to limit the disclosure only to these examples and illustrations.

Various modifications and alternate constructions are possible. The different variations from the examples disclosed fall within the scope of the disclosure, which is to be defined by the following claims.

The invention claimed is:

1. A system for providing lighting comprising a light head mounted on a common base, the light head including a light source in a mounting base, the base being mounted on a collapsible elongated pole, the pole being for mounting on an outside wall of a carrying case, the carrying case being for locating the light head and collapsible pole when the light is not in use, a carrying handle for the case, an electrical power outlet mounted on a wall of the case and being for plugging in an electrical wire to power the light head, the interior of the case being for locating a rechargeable battery, and the battery being, when charged, for supplying power to the power outlet such that the light head can be powered, wherein the light source in the mounting base includes a light head with a panel of multiple LEDs mounted to a heat sink and wherein the heat sink is exposed to an ambient environment.

2. A system as claimed in claim 1 wherein the pole has components which are telescopic relative to each other such that the pole can be extended or collapsed and selectively locked at different degrees of extension, and in the collapsed state is locatable in an interior portion of the case.

3. A system as claimed in claim 1 including at least one connector element, the connector element being for securing the pole to the outside of the case.

4. A system as claimed in claim 1 including at least one connector element, the connector element being for securing the light head to the top of the pole.

5. A system as claimed in claim 1 including a second connector element, the second connector element being for securing the light head to the top of the pole.

6. A system as claimed in claim 1 wherein the carrying handle is extendible; and retractable, and in the retraction mode is essentially within the general perimeter space of the case.

7. A system as claimed in claim 1 wherein the case includes a pair of pulley wheels, the wheels being for facilitating the moving of the case.

8. A system as claimed in claim 1 wherein the heat sink is a cast aluminum heat sink.

9. A system as claimed in claim 1 wherein the light source is mounted on an extension telescopic pole which mounts on to the wall, lid or case of a case, and wherein inside the case there is a battery and charger which is chargeable via either a 12V DC automobile or a 110 AC power supply.

10. A system as claimed in claim 1 wherein the panel of LEDs is an articulating light panel, and wherein a wall, lid or base of the case includes a single or multiple power outlet sockets, and wherein the case is formed of a relatively water and dust resistant plastic, ad wherein a seal is provided between movable components of the case to facilitate this resistance.

11. A system as claimed in claim 10 wherein the case includes wheels and an extension handle to facilitate movement of the case.

12. A system as claimed in claim 10 wherein the case includes bays, each bay being formed for receiving a light or other components of the light.

13. A system for providing lighting comprising a light head mounted on a common base, the light head including a light source in a mounting base, the base being mounted on a collapsible elongated pole, the pole being for mounting on an outside wall of a carrying case, the carrying case being for locating the light head and collapsible pole when the light is not in use, a carrying handle for the case, an electrical power outlet mounted on a wall of the case and being for plugging in an electrical wire to power the light head, the interior of the case being for locating a rechargeable battery, and the battery being, when charged, for supplying power to the power outlet such that the light head can be powered, wherein the light source in the mounting base includes a light head with a panel of multiple LEDs mounted to a heat sink and wherein the heat sink includes fins.

14. A system as claimed in claim 13 wherein the carrying handle is extendible; and retractable, and in the retraction mode is essentially within the general perimeter space of the case.

15. A system as claimed in claim 14 wherein the case includes a pair of pulley wheels, the wheels being for facilitating the moving of the case, the pole having components which are telescopic relative to each other such that the pole can be extended or collapsed and selectively locked at different degrees of extension, and in the collapsed state is locatable in an interior portion of the case, and including at least one connector element, the connector element being for securing the pole to outside of the case.

16. A system as claimed in claim 13 wherein the heat sink is a cast aluminum heat sink.

17. A system as claimed in claim 13 wherein the light source is mounted on an extension telescopic pole which mounts on to the wall, lid or case of a case, and wherein inside the case there is a battery and charger which is chargeable via either a 12V DC automobile or a 110 AC power supply.

18. A system as claimed in claim 13 wherein the panel of LEDs is an articulating light panel, and wherein a wall, lid or base of the case includes a single or multiple power outlet sockets, and wherein the case is formed of a relatively water and dust resistant plastic, ad wherein a seal is provided between movable components of the case to facilitate this resistance.

* * * * *